US005142722A

United States Patent [19]

Kolb

[11] Patent Number: 5,142,722

[45] Date of Patent: Sep. 1, 1992

[54] TRANSFER PRINTING OF FURNITURE END PIECES

[75] Inventor: Kenneth W. Kolb, Louisville, Ky.

[73] Assignee: Rosalco, Inc., Jeffersonville, Ind.

[21] Appl. No.: 661,678

[22] Filed: Feb. 27, 1991

[51] Int. Cl.[5] ..... D06P 3/54; D06P 7/00

[52] U.S. Cl. ..... 8/471; 8/472; 8/506; 8/509; 8/512

[58] Field of Search ..... 8/471

[56] References Cited

U.S. PATENT DOCUMENTS

| | | | |
|---|---|---|---|
| 3,952,131 | 4/1976 | Sideman | 428/334 |
| 4,059,471 | 9/1977 | Haigh | 156/244 |
| 4,395,263 | 6/1983 | Davis | 8/471 |
| 4,465,728 | 1/1984 | Haigh et al. | 428/156 |
| 4,758,952 | 11/1988 | Harris et al. | 364/300 |
| 4,842,613 | 9/1989 | Purser | 8/471 |

OTHER PUBLICATIONS

Derwent Abstracts, Abstract No. 78-23503A, "Printing Flat Goods with Sublimable Dye", German Patent DE 26422350, Mar. 23, 1978.

*Primary Examiner*—A. Lionel Clingman
*Attorney, Agent, or Firm*—Rhodes, Coats & Bennett

[57] ABSTRACT

A process for applying images by transfer printing disperse dyes onto furniture end pieces, especially end pieces for use in juvenile furniture. In one preferred embodiment the end piece board is first coated with a pigmented non-polyester base coat which is applied with rollers and conventionally cured. The board is then coated with a 100% polyester clear top coat which is also applied with rollers and UV cured. In a second preferred embodiment the board is coated with a pigmented polyester base coat which is either sprayed or roll coated and which may be either conventionally or UV cured. Finally a sublimation decal is transfer printed into the polyester coating using a press having heated platens and operated at about 400° F. and at between 8–30 psi for between 20–40 seconds. For larger boards, a silicone pad may be attached to the upper platen of the heat press adjacent to the surface of the platen which contacts the transfer printing decal to improve image transfer for uneven presses. Also, for larger boards, the surface of the board opposite the side upon which the transfer print is applied is heated to a temperature about 10° to 15° F. greater than that side to substantially eliminate any warpage of the board during the transfer process.

9 Claims, 2 Drawing Sheets

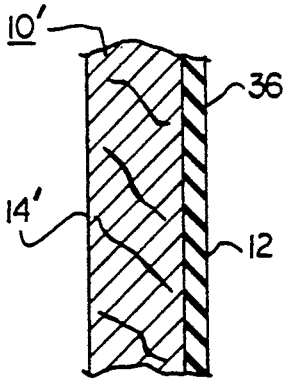
FIG. 4
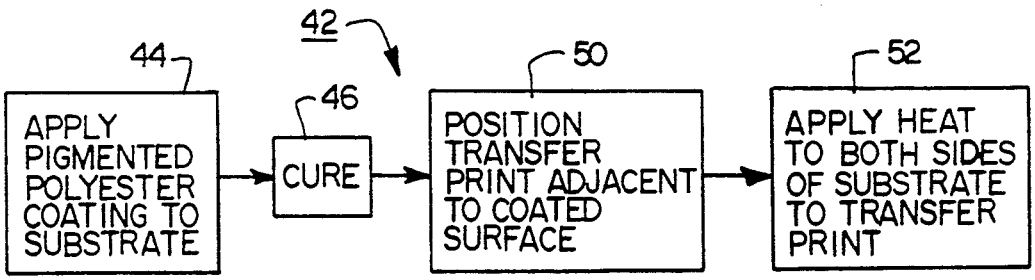
FIG. 5
FIG. 6
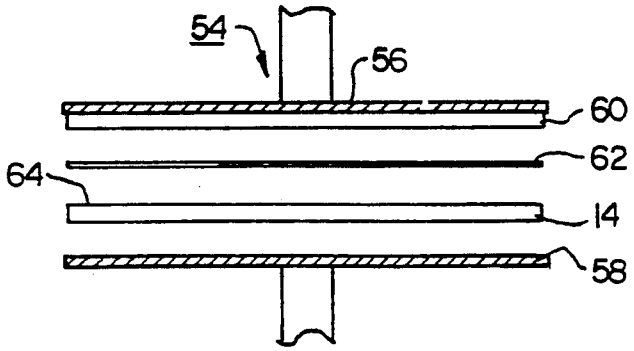

TRANSFER PRINTING OF FURNITURE END PIECES

BACKGROUND OF THE INVENTION (1) Field of the Invention

The present invention relates generally to transfer printing with disperse dyes and, more particularly, to a process for applying images by transfer printing to furniture end pieces, especially end pieces for use in juvenile furniture.

(2) Description of the Prior Art

Conventionally images are applied to furniture end pieces, for example juvenile furniture including bed head and foot boards, desk and chest tops, and chair seats, by first painting the end piece with a pigmented base coat to obtain a background color. Next the desired image is silk screened over the base coat. However, complex images, such as cartoon characters, require six or more colors. This requires that the board be handled each time a separate color is applied making tight registration difficult. Finally, after all the individual colors have been applied, the board is returned to the paint line to have a clear top coat applied over the image.

Heat transfer printing is a process used for printing fabrics of polyester or other thermoplastic fibers with disperse dyes. The design is transferred from a preprinted paper carrier onto the fabric by contact heat. Having no affinity for paper, the dyes are absorbed by the fabric. The process is capable of producing well-defined, clear prints.

U.S. Pat. No. 4,395,264, issued to Davis, discloses a method for producing a laminate bearing a permanently visible pattern. The laminate comprises a binder layer containing pigment and a transparent layer, each layer being formed for a synthetic polymer such as polyester. Sublimable dyestuff is heat transferred from an auxiliary web to the transparent layer to submerge the pattern into an external surface of the transparent layer.

U.S. Pat. No. 3,952,131, issued to Sideman, discloses a heat transfer print sheet comprising a base sheet, printing on the base sheet, and a coating overlying the printed surface. The printing is capable of transferring through the coating upon application of heat and pressure. In one embodiment (see FIG. 3) the substrate is a hard board and the coating is a polyester film.

German Patent No. DE2642350, issued to Schulzen, discloses a method for printing flat goods and coating with a synthetic by, with the application of heat, providing the flat goods with a surface layer of a thermoplastic synthetic material and printing the surface by the transfer printing method. The flat goods may be wood, chipboard, mineral wool, metal ceramic, glass, natural synthetic, stone, foams, natural or synthetic fabrics. The wooden flat goods may be in the form of furniture.

U.S. Pat. No. 4,758,952, issued to Harris, Jr. et al., discloses a method for computerized transfer printing into a substrate. Various substrates may be employed including paper, wood, plastic, natural cloth, synthetic cloth, carpet material, concrete, glass, metal, such as steel, porcelain and ceramic.

U.S. Pat. Nos. 4,059,471 and 4,465,728, issued to Haigh, disclose a method and product produced thereby for dye absorption into the surface of plastics. The process includes placing polyolefin film between a dye transfer paper and a sheet of thermoplastic and applying sufficient heat and pressure thereto.

Finally, U.S. Pat. No. 4,842,613, issued to Purser, discloses a process for heat transfer printing a pattern of disperse dyes onto a non-metallic inorganic surface such as glass or ceramic.

The above processes are generally limited either to multiple coating layers, inorganic substrates or articles which are too small to be useful as furniture components. Thus, there remains a need for a new and improved process for applying images by transfer printing to furniture end pieces, especially end pieces for use in juvenile furniture, which is simple and economical to use while, at the same time, prevents warpage which may occur when wooden substrates are heated during the transfer process.

SUMMARY OF THE INVENTION

The present invention is directed to a process for applying images by transfer printing disperse dyes onto furniture end pieces, especially end pieces for use in juvenile furniture. In one preferred embodiment the end piece board is first coated with a pigmented non-polyester base coat which is applied with rollers and conventionally cured. The board is then coated with a 100% polyester clear top coat which is also applied with rollers and UV cured. Finally a sublimation decal is transfer printed into the polyester coating using a press having upper and lower heated platens and operated at about 400 F and at between 8–30 psi for between 20–40 seconds. For boards over about 15×15 inches, a silicone pad may be attached to the upper platen of the heat press adjacent to the surface of the platen which contacts the transfer printing decal. The silicone pad helps to compensate for unevenness between the platen and board surfaces, thereby reducing or eliminating "blowout" which occurs for the larger boards. However, in the most preferred embodiment, the evenness of the platens is closely controlled and the pad is not used.

In a second preferred embodiment the board is coated with a pigmented polyester base coat which is either sprayed, roll coated or flow coated and which may be either conventionally or UV cured. The image is then transferred directly into the pigmented polyester base coat as previously described.

When printing larger and pieces, such as boards having one dimension greater that about 40 inches, it has been discovered that the board tends to warp in the direction of the transfer printing sheet when subjected to heat in the press. This phenomenon occurs when through there is apparently no difference in temperature between the surfaces of the substrate adjacent to and opposite to the transfer printing sheet. However, it has also been discovered that the board will tend to warp in the direction of a higher temperature platen. Accordingly, in the preferred embodiments of the present invention the surface of the board opposite the side upon which the transfer print is applied is heated to a temperature about 10 to 15 F greater than that side, whereby substantially eliminating any warpage of the board during the transfer process. The actual temperature difference is chosen based on the weight of the paper of the transfer sheet with higher weight papers generally requiring a sightly higher temperature difference.

Finally it has been discovered that transfer printing decals produced by offset printing are much less likely to migrate and produce blurred images over time when compared to conventional, solvent-based silk screen printed decals.

Accordingly, one aspect of the present invention is to provide a process for applying a disperse dye printed pattern to a substrate comprising the steps of: (a) applying an organic polymeric coating containing a pigment onto one surface of the substrate; (b) curing the organic polymer coating; (c) applying a printed image to the organic polymeric coating by applying a carrier sheet containing sublimable or disperse dyes thereon; and (d) heating the disperse dyes on the carrier sheet under pressure to transfer the dyes onto the organic polymer coating.

Still another aspect of the present invention is to provide a process for applying a disperse dye printed pattern to a substrate comprising the steps of: (a) applying a first organic polymeric coating containing a pigment onto one surface of the substrate; (b) curing the first organic polymeric coating; (c) applying a second organic polymeric coating, the second organic polymeric coating being substantially pigment free, onto the first organic polymeric coating on the surface of the substrate; (d) curing the second organic polymeric coating; (e) applying a printed image to the second organic polymeric coating by applying a carrier sheet containing sublimable or disperse dyes thereon; and (f) heating the disperse dyes on the carrier sheet under pressure to transfer the dyes onto the second organic polymeric coating.

These and other aspects of the present invention will become apparent to those skilled in the art after a reading of the following description of the preferred embodiment when considered with the drawings.

BRIEF DESCRIPTION OF THE DRAWINGS

FIG. 4 is an enlarged sectional view of an article of furniture illustrating an alternative embodiment of the present invention;

FIG. 5 is a diagrammatic view of the process of preparing the alternative embodiment shown in FIG. 4; and FIG. 6 is a partial sectional elevational view of a heat transfer printing apparatus embodying the present invention.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
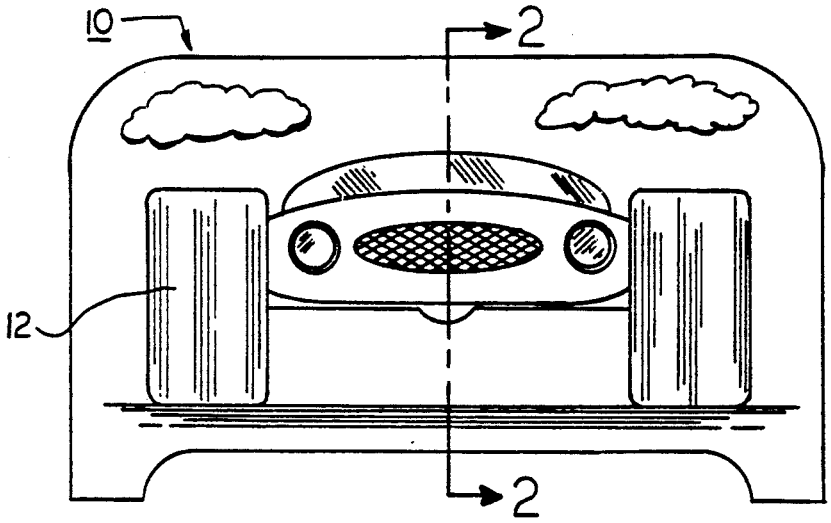
FIG. 1 is a front view of an article of furniture treated with a decorative pattern according to the present invention.

Referring now to the drawings in general and FIG. 1 in particular, it will be understood that the illustrations are for the purpose of describing a preferred embodiment of the invention and are not intended to limit the invention thereto. Turning first to FIG. 1, there is shown a front view of an article of furniture 10 treated with a decorative pattern 12 according to the present invention.

Figure 2:
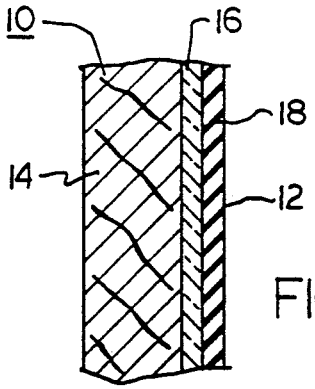
FIG. 2 is an enlarged sectional view of the article of furniture shown in FIG. 1, taken along line 2—2.

As best seen in FIG. 2, there is shown an enlarged cross-sectional view of the furniture article 10 shown in FIG. 1, taken along lines 2—2. In the preferred embodiment shown, the article 10 includes a wooden substrate of medium density fiberboard (mdf) 14, a non-polyester pigmented base coat 16, and a clear 100% polyester cover coat 18. The thickness of the wooden substrate 14 is typically between $\frac{1}{4}$ and $\frac{3}{4}$ inches. The area of the board may be as large as $82 \times 26$ inches.

The non-polyester pigmented base coat 16 may be of any conventional lacquer base paint so long as the paint has a temperature resistant at least about 400 F. The non-polyester pigmented base coat 16 is applied in a conventional manner either by rollers or coating and to thickness of approximately 0.5–6 mils. After being applied, the pigmented base coat 16 can either be cured conventionally by heat or UV radiation.

Following the application of the non-polyester pigmented base coat 16, a second coat of clear 100% polyester is applied to the surface of the first coat 16. Again the application and curing may be by conventional means as described above. One polyester coating which has been found particularly suitable is 615-9051 Clear Direct Gloss Polyester Top Coat manufactured by Crown Metro Wood Coating, Inc. of Lepoir, N.C. The preferred polyester paint is high in solids and low in VOC's (e.g. 0.11 lbs./gal. as compared with 2 or more lbs./gal. for conventional paints) which appears to reduce the tendency of the transfer printed images to migrate over time.

The heat transfer sheet having the printed decal is generally conventional in design. The sublimable dye stuffs printed on the paper includes any dye stuffs which has been known for that purpose, such as dispersed dye stuffs which pass into the vapor state under heat and pressure conditions. In this regard, suitable dye stuffs are referred to in dePlasse in U.S. Pat. No. 3,813,218, the entire disclosure which is hereby incorporated by reference. The dyestuffs may h-e printed on the heat transfer paper either by conventional or offset printing techniques. However, it has been found that heat transfer decals produced by the offset printing technique are more resistant to "blowout" then decals produced by other techniques. Apparently this is improvement in image quality is due to lower levels of ink buildup produced by the higher precision and uniformity of offset printing the decals. One source of such decals is Miller/Zell located in Atlanta, Ga.

Figure 3:
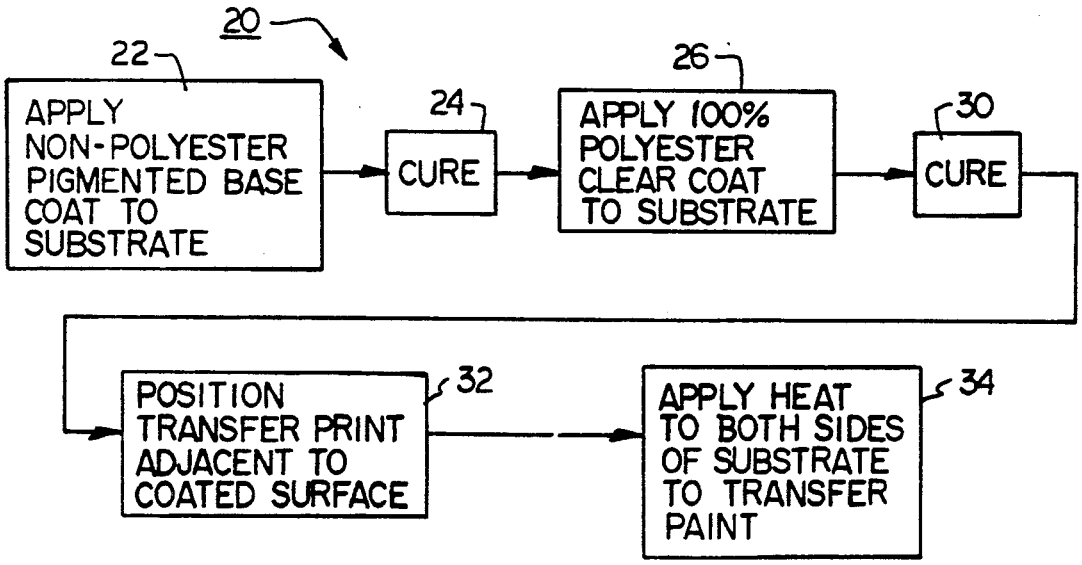
FIG. 3 is a diagrammatic view of the process of preparing the article of furniture shown in FIG. 1.

As best seen in FIG. 3, there is shown a diagrammatic view of the process of producing the article of furniture 10 shown in FIG. 1. It has been found that it is necessary to apply heat to both sides of the substrate to transfer the print in order to prevent warpage of the substrate 14 addition, preferably the heated temperature of the surface of the substrate opposite the heat transfer carrier sheet is greater than the heated temperature of the surface of the substrate adjacent to the sheet. As will be shown in greater detail, it has been discovered there is a natural tendency of the wooden substrate 14 to warp in the direction of the heat transfer sheet. In order to compensate for this warpage, which is particularly noticeable in larger articles 10, it has been discovered that the tendency of warpage can be compensated for by applying a slightly higher temperature to the surface of the substrate 14 opposite that upon which the carrier sheet is being applied thereto.

As best seen in FIG. 4, there is shown in enlarged sectional view of an article of furniture similar to that shown in FIG. 1, illustrating an alternative embodiment of the present invention. Instead of having a two layer of a first layer pigmented and a second layer being clear coat, only a single layer of pigmented polyester or cross-linked acrylic coating 36 is utilized. One paint which has been found to be particularly suitable is 614-0050 White Direct Glass Polyester Top Coat manufactured by Crown Metro Wood Coatings, Inc. of Lenoir, N.C.

As best seen in FIG. 5, the use cf a single pigmented coating or a cross-linked acrylic resin board. 36 eliminates two strips of the process previously shown in FIG. 3. The pigmented polyester coating 36 can be applied by any conventional means including rollers or spray and cured either conventionally or by UV radiation. Surprisingly, the presence of the pigment in the coating does not affect the quality of the image from the heat transfer print. The dye colors are calibrated for each coating according to standard Pantel Matching System (PMS) colors.

A schematic view of an apparatus suitable for carrying out of described processes is shown in FIG. 6. The apparatus 54 is generally conventional heat press having pair of opposed upper and lower platens 56,58. One such press which has adapted for this purpose is a Model D-A 8/18.5T manufactured by Kannegiesser Machinenfabrik GMB located in Germany. In the present apparatus, the upper platen 56 is modified to include the attachment of a silicone pad 60 to its downwardly extending surface. The printed transfer sheet 62 is laid face-down against surface of the receptor coating 64 on substrate 14. Upper and lower platens 56,58 are electrically or otherwise heated to approximately 400 F. However, independent temperature controls are used to allow the lower platen 58 to be maintained at a slightly higher temperature than the upper platen 56.

The process and product according to the present invention will become more apparent upon reviewing the following detailed examples:

EXAMPLES 1-9

Board sizes of 9×24×3/4 (Examples 1-6) and 20×40×1/2 (Examples 7-9) inches thick were printed with heat transfer decals on paper of 60-80 lbs. All of the boards were roll-coated with a white lacquer, conventionally cured base coat and with a UV cured 100% polyester clear top coat. The press was operated at between 38°F. and 400 F for 30-40 seconds and at 8-10 psi. A silicone pad was permanently attached to the top platen. Only the upper platen was heated for Examples 1-6. The gloss was 2 on a scale of 1-4. There were no double exposures and durability was very good. There was some "blowout" at the higher temperature end but none at the lower temperature end. The intensity of the image varied between 1 and 3 on a scale of 1-3 and the evenness of print was between no good and very good. Warpage occurred on all of the larger board samples. Of the 9 examples, Example 6 using 60 lb. paper applied at 380 F for 40 seconds at 10 psi produced the best results.

TABLE 1

Relationship of Time, Temperature and Pressure

| Example No. | Time (Sec) | Temp (F.) | Pressure (PSI) | Intensity of Color | Evenness of Print |
|---|---|---|---|---|---|
| 1 | 30 | 400 | 8 | 2 | G |

TABLE 1-continued

Relationship of Time, Temperature and Pressure

| Example No. | Time (Sec) | Temp (F.) | Pressure (PSI) | Intensity of Color | Evenness of Print |
|---|---|---|---|---|---|
| 3 | 30 | 380 | 8 | 2 | G |
| 6 | 40 | 380 | 10 | 3 | VG |
| 8 | 40 | 380 | 3 | 1 | NG |

The above examples show that a minimum time, temperature and pressure are needed to achieve a satisfactory print. Also, raising the pressure for a given time will improve print quality. Thus, for 380 F for 40 seconds, at least 10 PSI is required to produce an optimum quality print.

EXAMPLES 9-16

Board sizes of 20×40×1/2 inches thick were printed using transfer decals printed on 60-80 lb. paper. All of the boards were roll-coated with a white lacquer, conventionally cured base coat and with a UV cured 100% polyester clear top coat. The press was operated at between 380 F and 422 F for between 20 and 40 seconds at between 3 and 20 psi. Both the upper and lower platens were heated to the same temperatures. A silicone pad was loosely attached to the upper platen for the examples except Example 10. The gloss values were 2. There was no double exposures and durability was all very good. There was some "blowout" for Example 10 without the silicone pad. The intensity of color varied from 1 to 3 and approximately half of the samples produced an unacceptable evenness of print. This was most noticeable for the samples at the lower temperatures and for the shorter times. Substantially all the boards showed pronounced warpage up to a maximum of ¼ inches. Of the examples, the most preferred were those processed at between 410 F and 422 F and between 14 and 20 psi for between 30 and 40 seconds depending on the paper weight.

TABLE 2

Effect of Paper Wt. on Time, Temp. and Pressure

| Example No. | Time (Sec) | Temp (F.) | Pressure (PSI) | Paper (lbs) | Intensity of Color | Evenness of Print |
|---|---|---|---|---|---|---|
| 10 | 30 | 380 | 14 | 60 | 3 | G |
| 13 | 30 | 410 | 14 | 60 | 3 | VG |
| 14 | 40 | 410 | 17 | 80 | 1 | VG |
| 15 | 40 | 410 | 20 | 80 | 1 | VG |
| 16 | 40 | 422 | 20 | 80 | 3 | VG |

Heating both top and bottom platens to the same temperature did not reduce warpage. Also heavier transfer paper required an increase in time, temperature and pressure to produce the same quality print. Finally, the loose pad contributed to warpage and required an increase in time and temperature to produce the same quality print.

EXAMPLE 18

A 20×40×1/2 inches board was printed using 60 lb. hcat transfer decals. The board was roll-coated with a white lacquer, conventionally cured base coat and with a UV cured 100% polyester clear top coat. The press was operated at 410 F for 40 seconds at 17 psi. Both the upper and lower platens were heated to the same temperatures. A silicone pad was used on both the top and bottom sides. The use of a silicone pad on both the top and bottom produced an uneven print.

EXAMPLES 19-25

Board sizes of 15×15, 20×40, and 40×6 ½ inches by ½ inches thick were printed using heat transfer decals on between 60 and 70 lb. paper. All of the boards were roll-coated with a white lacquer, conventionally cured base coat and with a UV cured 100% polyester clear top coat. The press was operated at between 406 F and 420 F for 30 seconds and at between 14 and 49 psi. The lower platen was operated at the same temperature or slightly higher than the upper platen. No silicone pad was used on either the top or the bottom platen. However, both printed and unprinted paper was used on the bottom platen. The resulting images had loss values of about 2 with no double exposures and very wood durability. However, substantially all of the samples had significant "blowout". The intensity of color of the printed image varied between 2 and 3 and the evenness of the print was very good. Warpage varied between 0 and 50/1000 inches.

TABLE 3

Effect of Temperature Difference on Warpage

| Example No. | Top Temp (F.) | Bot. Temp (F.) | Difference (F.) | Size (in) | Warpage/ 1000" |
|---|---|---|---|---|---|
| 19 | 410 | 410 | 0 | 15 × 15 | 0 |
| 22 | 406 | 420 | 14 | 40 × 6.5 | 0 |

These examples show that board sizes which would normally warp exhibit substantially zero warpage, equivalent to smaller board sizes, when the platen on the side opposite to the side adjacent to the transfer decal is maintained at a slightly elevated temperature.

EXAMPLES 26-32

These samples were all coated with a UV cured, white pigmented 100% polyester top coat. No clear top coat was used. Board sizes varied from 9×24 to 15×11 to 20×40 inches by ½ to ¾ inches in thickness. The weight of the printed decal varied between 60 and 80 lbs. The temperature of the press was set between 380 F and 410 F and operated for between 20 and 40 seconds at between 3 and 29 psi. Four of the samples were without any heat to the lower platen. All of the samples used a silicone pad on the top platen. None of the samples had printed paper on the bottom platen. Of the samples, all had a gloss valve of at least 3 without any double exposures and very good durability. None of the samples had any "blowout". The intensity of color varied between 1 and 3 with 1 being for the lower temperature samples. The samples also had unacceptable evenness of print Warpage ranged between 1/16 and 3/16 inches. Of the samples, the most preferred, excluding warpage, were applied at between 11 and 29 psi.

TABLE 4

Relationship of Time and Temperature

| Example No. | Time (Sec) | Temp (F.) | Pressure (PSI) | Gloss | Intensity of Color | Evenness of Print |
|---|---|---|---|---|---|---|
| 26 | 20 | 400 | 13 | 3 | 3 | VG |
| 27 | 40 | 380 | 11 | 3 | 3 | VG |
| 31 | 30 | 410 | 29 | 3 | 3 | VG |
| 32 | 25 | 420 | 20 | 3 | 3 | VG |

These examples show that there is an inverse relationship between time and temperature at equivalent pressures (e.g. Examples 26 and 27). However, an increase in temperature appears to require a either an increase in pressure (Example 31) or a decrease in time (Example 32) in order to prevent "blowout". Finally, the pigmented polyester paint coatings all produced gloss values of 3 compared to gloss values of 2 for the non-pigmented polyester top coatings in Example 1-25.

EXAMPLES 33-35

Uncoated boards of 24×9 and 15×26 inches and ⅝ inches thick were put in the press at between 405 F and 415 F for 30 seconds and at between 14 and 51 psi with no transfer decal present. Both the upper and lower platens were heated. No silicone pad was used on either the upper or lower platens.

TABLE 5

Effect of Transfer Paper on Warpage

| Example No. | Top Temp (F.) | Bot. Temp (F.) | Difference (F.) | Size (in) | Warpage/ 1000" |
|---|---|---|---|---|---|
| 33 | 410 | 410 | 0 | 24 × 9 | 0 |
| 34 | 405 | 415 | 10 | 15 × 26 | 0 |
| 35 | 405 | 415 | 10 | 15 × 26 | 0 |

These examples illustrate that no warpage is detected when there is no transfer decal present even when the temperatures of the upper and lower platens are different. Therefore, warpage of larger board sizes must be the result of the interaction of the transfer decal with the surface of the board adjacent to the decal.

EXAMPLES 36-41

Uncoated boards of 15×26×5/8 inches up to 32×16×⅝ inches were printed with 60 lb. heat transfer decals paper. The upper platen temperature was varied between 395 F and 405 F. The lower platen was initially set at 415 F. Example 40 used a silicone pad loosely attached on the top surface only, example 39 used a silicone pad loosely attached on the bottom surface only and example 41 did not use any pad. No paper was used on the bottom platen.

TABLE 6

Effect of Pads on Warpage

| Example No. | Top Temp (F.) | Bot. Temp (F.) | Difference (F.) | Size (in) | Warpage/ 1000" |
|---|---|---|---|---|---|
| 39 | 405 | 415 | 10 | 15 × 26 | +50 |
| 40 | 405 | 415 | 10 | 15 × 26 | −50 |
| 41 | 395 | 415 | 20 | 32 × 16 | +50 |

The results of the above examples show warpage varied between 25/1000 and 50/1000 inches positive to 50/1000 inches negative for the sample using the silicone pad on the top surface only. Thus, a loose, non-preheated silicone pad on the top (Example 40) *reverses* the normal warpage of the board when a transfer decal is present without a pad (Example 41). Also, a loose, nonpreheated silicone pad on the bottom (Example 39) increases the normal warpage of the board when a transfer decal is present without a pad (Example 41). Therefore, the board appears to warp away from whichever side has the loose non-preheated silicone pad adjacent thereto.

Certain modifications and improvements will occur to those skilled in the art upon reading of the foregoing description. By way of example, the location and degree and type of attachment of the top and/or bottom pads may reduce or substantially eliminate the need for maintaining a difference in temperature between the top and bottom platens. It should be understood that all such modifications and improvements have been deleted herein for the sake of conciseness and readability but are properly within the scope of the following claims.

I claim:

1. A process for applying a disperse dye printed pattern to a wooden substrate comprising the steps of:

(a) applying an organic polymeric coating containing a pigment onto one surface of the substrate;

(b) curing said organic polymeric coating;

(c) applying a printed image to said organic polymeric coating by applying a carrier sheet containing sublimable dyes thereon;

(d) positioning a pad adjacent to the surface of the substrate having said carrier sheet applied thereto; and (e) heating said disperse dyes on said carrier sheet under pressure to transfer the dyes onto said organic polymeric coating, wherein step (e) further includes heating both surfaces of the substrate and wherein the heated temperature of the surface of the substrate opposite said carrier sheet is about 10 to 15 degrees F greater than the heated temperature of the surface of the substrate adjacent to said carrier sheet.

2. The process according to claim 1 wherein said organic polymeric coating is selected from the group consisting of thermosetting resins.

3. The process according to claim 2 wherein said organic polymeric coating is a polyester resin.

4. The process according to claim 2 wherein said organic polymeric coating is a cross-linked acrylic resin.

5. The process according to claim 1 wherein said organic polymeric coating is cured by exposure to UV light.

6. The process according to claim 1 wherein said disperse dyes are heated to a temperature of between about 380 to 420 F at between about 8 to 30 psi for between about 20 to 40 seconds.

7. A process for applying a disperse dye printed pattern to a wooden substrate comprising the steps of:

(a) applying a first organic polymeric coating containing a pigment onto one surface of the substrate;

(b) curing said first organic polymer coating;

(c) applying a second organic polymeric coating, said second organic polymeric coating being substantially pigment free, onto said first organic polymeric coating on the surface of the substrate;

(d) curing said second organic polymeric coating;

(e) applying a printed image to said second organic polymeric coating by applying a carrier sheet containing sublimable or disperse dyes thereon;

(f) positioning a pad adjacent to the surface of the substrate having said carrier sheet applied thereto; and (g) heating said disperse dyes on said carrier sheet under pressure to transfer the dyes onto said second organic polymeric coating, wherein step (g) further includes heating both surfaces of the substrate and wherein the heated temperature of the surface of the substrate opposite said carrier sheet is about 10 to 15 degrees F greater than the heated temperature of the surface of the substrate adjacent to said carrier sheet.

8. The process according to claim 7 wherein said second organic polymer coating is selected from the group consisting of thermosetting resins.

9. The process according to claim 8 wherein said second organic polymeric coating is a polyester resin.

* * * * *